US005106082A

United States Patent [19]

Moschetti et al.

[11] Patent Number: 5,106,082

[45] Date of Patent: Apr. 21, 1992

[54] BELT APPARATUS

[76] Inventors: Mitchell R. Moschetti, P.O. Box 10834, Denver, Colo. 80236; Jeffrey J. Smith, 3353 S. Monaco St., Denver, Colo. 80237; William Hollander, 5012 Valhalla Dr., Boulder, Colo. 80301

[21] Appl. No.: 543,659

[22] Filed: Jun. 26, 1990

[51] Int. Cl.[5] ..... A63B 21/00

[52] U.S. Cl. ..... 482/139; 224/259; 482/105

[58] Field of Search ..... 272/93, 117, 119, 123, 272/139, 143; 224/184, 201, 202, 204, 218, 257, 258, 259, 260

[56] References Cited

U.S. PATENT DOCUMENTS

| | | | |
|---|---|---|---|
| 1,846,846 | 2/1932 | Coffman | 224/259 |
| 1,871,223 | 8/1932 | Reese | 224/204 |
| 4,337,938 | 7/1982 | Rodriguez | 272/143 X |
| 4,589,658 | 5/1986 | Gibson | 272/119 X |
| 4,706,858 | 11/1987 | Whatley | 224/184 |
| 4,986,537 | 1/1991 | D'Orta | 272/119 X |

FOREIGN PATENT DOCUMENTS

| | | | |
|---|---|---|---|
| 269821 | 7/1950 | Switzerland | 272/143 |

*Primary Examiner*—Robert Bahr

[57] ABSTRACT

An exercise belt apparatus for supporting at least one load about a user includes first, second and third lengths of webbing. The first ends of the second and third lengths are adjustably connected to one another. The first and second ends of the first length are slidingly connected along the respective lengths of the second and third lengths such that the user is secured between the first length and the portion of the second and third length connected between the ends of the first length. Releasable connection means adjustably located at the second ends of second and third lengths are provided for securing the second and third lengths to the at least one load.

2 Claims, 2 Drawing Sheets

BELT APPARATUS

BACKGROUND OF THE INVENTION

1. Field of the invention

The present invention relates to a belt apparatus, and more particularly to an belt apparatus to be used in the performance of various exercises.

2. Description of the Prior Art

Belts devices are commonly used in the performance of exercises, either to support the user's body (such as a spotting belt used in gymnastics) or to support a load upon the body. Such conventional exercise belts suffer from various disadvantages.

One common disadvantage is that such belts are typically designed to be secured about the user in a manner in which the load is brought to bear on the user's lumbar vertebrae. Lumbar vertebrae, which move relative to one another, are not capable of safely supporting large loads. Use of such belts therefore commonly results in injury.

Many conventional exercise belts are also designed so that they have a fixed perimeter length when secured about the user. For example, a tongue and groove mechanism is commonly employed to secure the ends of exercise belts about the users. Such fixed length perimeter belts suffer from the disadvantage that they tend to slip when loads greater than a certain magnitude are applied, or when a load is applied in a direction different from the prior direction. Depending upon the amount of the load and the degree of slippage, injury may result.

Other belts designs are disadvantageous because they do not provide any mechanism to allow the user to make adjustments to account for varying limb or other lengths of different users. For example, exercise devices are known in which elastic lengths (such as surgical tubing) extend from a platform beneath the user and are connected to hooks or loops located on a belt secured about the user. When the elastic having the same length is connected to belts secured about users having different leg lengths, the variation in resistance encountered can be substantial. This disadvantage is also applicable to other elastic devices such as pneumatic and hydraulic actuated devices.

Still other belts are disadvantageous because either bulk or the manner in which they are secured prevents the user from performing sport specific movements.

SUMMARY OF THE INVENTION

The present invention relates to an exercise belt apparatus for supporting at least one load about a user including first, second and third lengths of webbing. The first ends of the second and third lengths are adjustably connected to one another. The first and second ends of the first length are slidingly connected along the respective lengths of the second and third lengths such that the user is secured between the first length and the portion of the second and third length connected between the ends of the first length.

When properly positioned below the iliac crest of the hips, the belt distributes the load across the hips and sacral vertebrae, reducing the likelihood of injury. Lifting of the load also tends to increase the tension of the belt apparatus about the user, reducing the likelihood of slippage.

Releasable connection means adjustably positioned near the second ends of the second and third lengths allow the user adjust the amount of the second and third length between the hips and the load.

BRIEF DESCRIPTION OF THE DRAWINGS

In the description which follows, an illustrative embodiment of the present invention is explained in great detail with the aid of drawings in which.

DETAILED DESCRIPTION OF THE PREFERRED EMBODIMENT

For the purposes of illustration only, the present invention is described in terms of its preferred physical embodiment. It will be apparent to those skilled in the art that the present invention is not limited in scope to the preferred physical embodiment, but rather is adaptable to numerous other embodiments. Similarly, various modifications and improvements may be made to the present invention as it relates to the preferred physical embodiment and other alternate embodiments without departing from the scope and spirit of the invention. Accordingly, the present invention is limited only by the scope of the appended claims.

Figure 1:
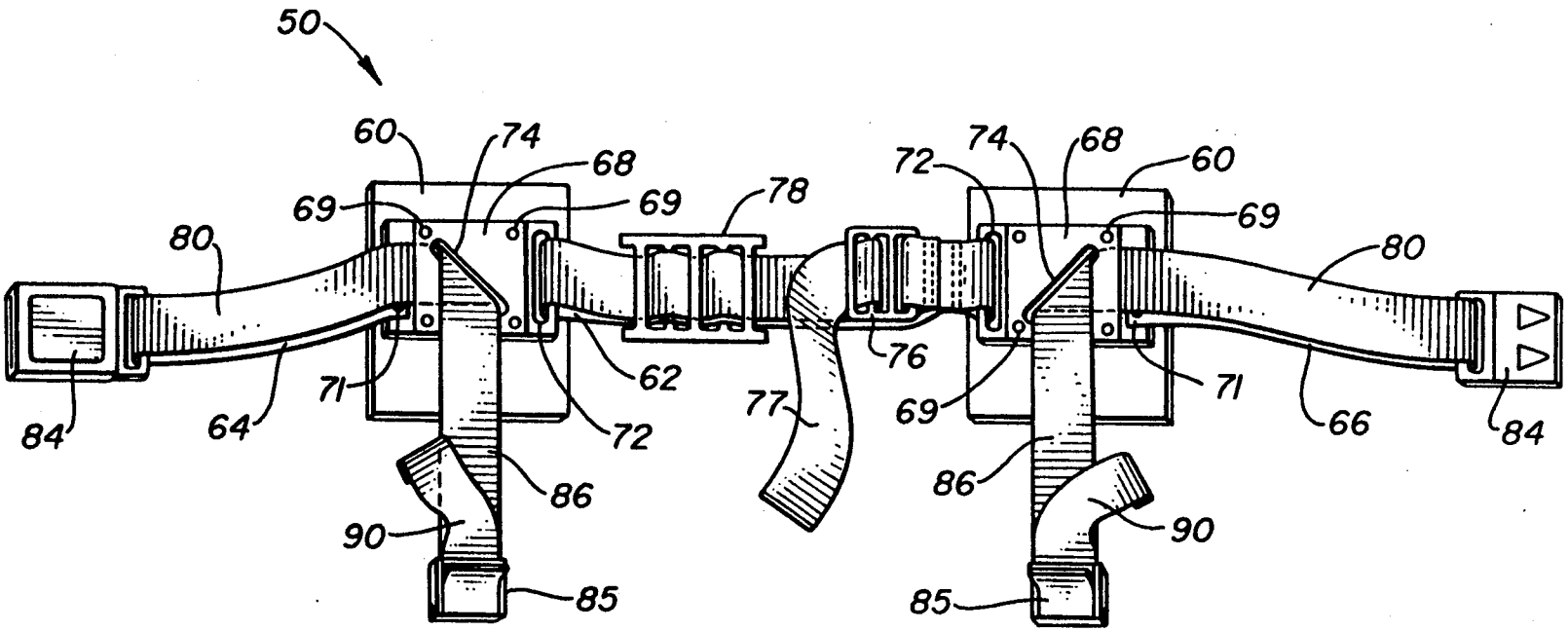
FIG. 1 is a back view of one embodiment of a belt apparatus of the present invention.

The preferred embodiment of the present invention is illustrated in FIG. 1. The exercise belt apparatus 50 includes two main pads 60 to be supported about the hips of the user, a first belt length 62 belt for securing the pads 60 together at the rear of the user, and a second 64 and third belt lengths 66 for securing the pads together at the front of the user, as well as for serving as means for attaching the cables 90 of the invention to the user. Each pad 60 includes a layer of conventional foam and plate of high density plastic plate made of HDPE or UHMW or the like, with a cover material such as cordura covering both layers. A unitary piece of hardware 68, preferably made of Delrin (tradename for a type of acetyl polymer) or other similar type of polymer, is secured to the outside of each pad 60 by means of bolthead screws 69 or the like which extend through to the high density plastic plate. The hardware, as illustrated, should preferably be formed with a vertical slot 72 through which the back length of the belt may pass, as well as an angled slot 74 through which the second 64 or third length 66 may pass.

The belt lengths are preferably formed of nylon webbing such as that found in aircraft seat belts, and should have characteristics sufficient to support the loads to be encountered. The first belt length 62 at the rear of the belt apparatus extends through the vertical slots 72 of the pad hardware, with one end of the length secured, preferably by sewing, as indicated, to a buckle 76 through which the opposite end passes. The buckle 76 should preferably be of an adjustable variety such as that illustrated, wherein the length of the end 77 passing therethrough may be adjusted to lengthen or shorten the effective size of the belt apparatus to accommodate for different sized users. A guide 78 made of plastic or the like may also be provided along the first length 62 to retain the doubled over portions in close proximity.

The second 64 and third 66 belt portions loop 80 back to the belt hardware 68 where they pass through the angled slots 74 and extend downward. The ends 71 of the lengths should be firmly attached to the pad hardware 68, preferably by means of bolthead screws which pass through to the high density plastic plate within the cover of the pad. Interacting adjustable position male and female buckles 84 are respectively provided along the along the front loops 80 to enable engagement by users of different sizes. Buckles portions 85 are also provided along the downward extending portions 86 of the belt lengths to allow for engagement with corresponding buckle portions (not shown) that are secured to the load. The buckle portions 85 should also be of the variety that can be adjusted along the length of the downward extending portions 86.

Figure 2B:
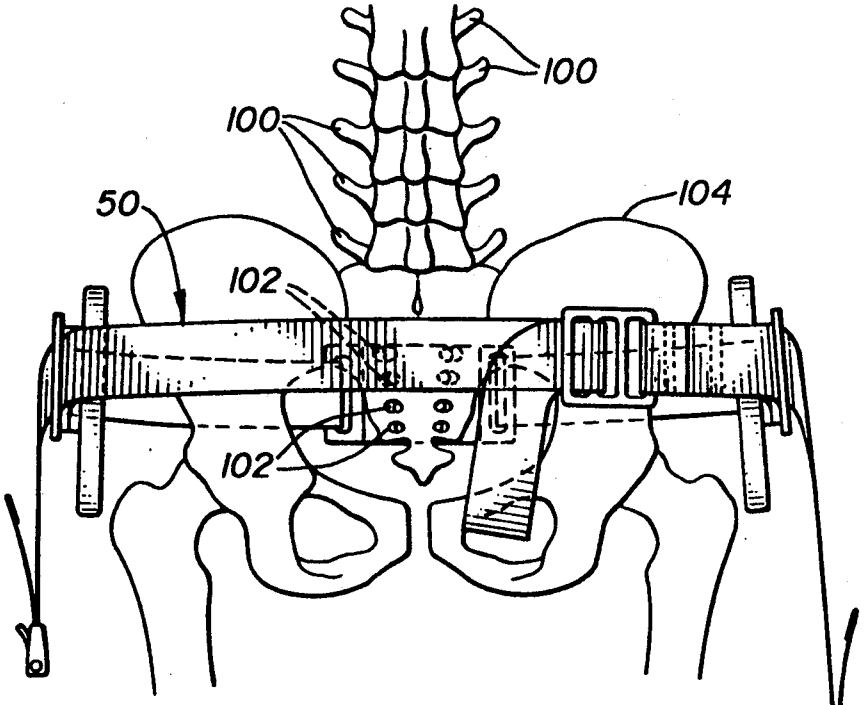
FIGS. 2*a* and 2*b* are respectively front and back views illustrating the proper positioning of an embodiment of the belt apparatus of the present invention.
Figure 2A:
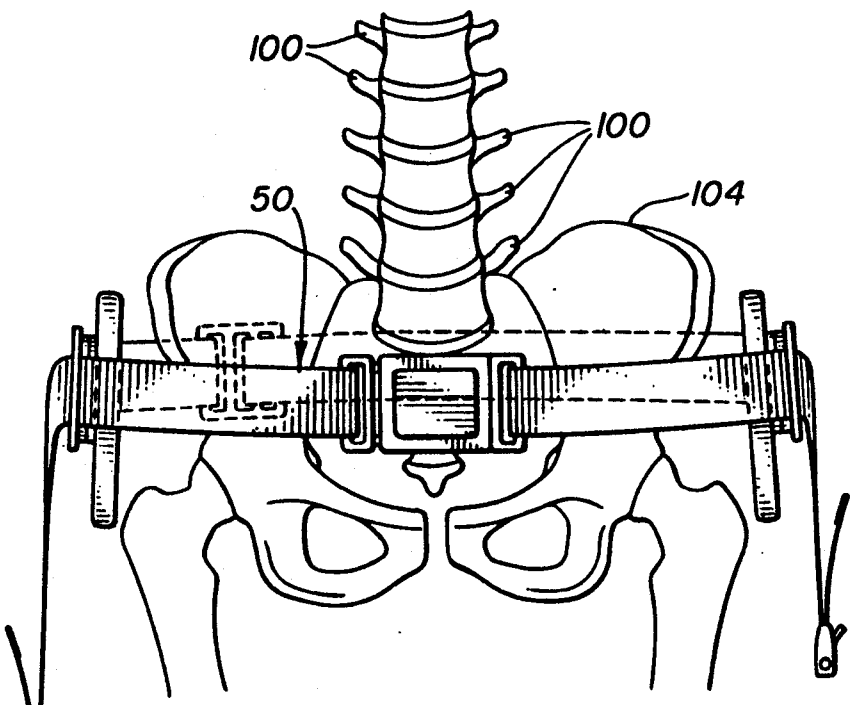

In operation, the user positions the pads 60 about the hips so that the webbing rides below the iliac crest 104, as illustrated in FIG. 2. In this position, the belt rides below the lumbar vertebrae 100 and across the sacral vertebrae 102. Because the sacral vertebrae are fused to one another, injury is reduced when compared to belts which ride across lumbar vertebrae. The user then adjusts the lengths of the front loops 80 and the length of the first belt length 62 so that the pads 60 are secured firmly in position about the user. The downward extending portions 86 of the second 64 and third 66 lengths should then be tensioned through the angled slots 74 to remove any slack in the front loops 80. The user, who up to this tie may have been distant from the load, approaches the load and secures the buckle portions 85 to the corresponding buckle portions of the load. The user then adjusts the buckle portions 85 to the desired position along the downward extending portions to obtain the desired tension, load, position, act. Preferably, the adjustment of the buckle position is obtained through the pulling of the ends 90.

The belt apparatus, when used in conjunction with the embodiment described above, vastly reduces the likelihood of injury to the user's back. The force bearing load is supported about the hips and in close proximity to the load bearing femurs of the legs, far away from the lumbar vertebrae. The force of the load on the downward extending portions is also transferred through the angled slots 74 to the second 64 and third 66 portions, increasing the tension of the belt about the user's hips. The belt is thus less likely to slip downward when heavier loads are applied. The iliac crest also serves to prevent slippage in the upward direction when the belt is positioned in this manner, even when no load is applied. Moreover, and unlike free weights and some elastic and cam based systems, the arms and remainder of the upper body are free to move in a normal manner, enabling sport specific training. For example, if the described embodiment is used to simulate jumping, the arms are free to be swung along the sides and extended above the head of the user.

Because the belt apparatus can be disengaged from the cables, the user is free to secure the belt apparatus without necessarily being in position for performing the exercise.

I claim:

1. An exercise belt apparatus for supporting at least one load about a user comprising:

a first and second plate member, each of the first and second plate members having a vertical slot and an angled slot;

a first, second and third length of webbing, each having a first and second end, the first ends of the second and third lengths of webbing being adjustably connected to one another, the first and second ends of the first length of webbing being connected to the vertical slots of the first and second plate member, respectively, the second length of webbing being slidably connected to the second plate member, and the third length of webbing being slidably connected to the first plate member such that a user is secured between the first length of webbing and the portion of the second and third lengths of webbing connected between the first and second plate members, the second and third lengths of webbing passing through the angled slots of the second and first plate members, respectively, such that the second ends of the second and third lengths of webbing extend at an angle with respect to the first ends of the second and third length of webbing; and connection means for releasably securing a load to the second and third lengths of webbing, the connection means being adjustably located of the second and third lengths between the second and third lengths between the second ends thereof and the sliding connection of the first and second plate members for securing the load to a desired position on the second and third length of webbing.

2. The exercise belt apparatus as recited in claim 1 wherein the first and second plate members include cushioned pads.

* * * * *